United States Patent [19]

Maglott

[11] 4,103,446

[45] Aug. 1, 1978

[54] FRAMING SYSTEM

[76] Inventor: Larry Franklin Maglott, 361b Commercial St., Provincetown, Mass. 02657

[21] Appl. No.: 699,190

[22] Filed: Jun. 23, 1976

[51] Int. Cl.[2] ..... G09F 1/12

[52] U.S. Cl. ..... 40/155; 248/488; 248/490; 40/152.1

[58] Field of Search ..... 40/152.1, 155, 156, 40/153; 248/490, 488

[56] References Cited

U.S. PATENT DOCUMENTS

| | | | |
|---|---|---|---|
| 412,953 | 10/1889 | Gale | 40/152.1 |
| 2,209,972 | 8/1940 | Horwitt | 40/152.1 |
| 2,810,226 | 10/1957 | Horwitt | 248/490 X |
| 3,256,630 | 6/1966 | Spector | 40/152.1 |
| 4,028,832 | 6/1977 | Wu | 40/155 |

FOREIGN PATENT DOCUMENTS

| | | | |
|---|---|---|---|
| 223,050 | 12/1942 | Switzerland | 40/155 |
| 576,430 | 4/1946 | United Kingdom | 40/153 |
| 774,530 | 5/1957 | United Kingdom | 40/155 |

*Primary Examiner*—Louis G. Mancene
*Assistant Examiner*—Wenceslao J. Contreras
*Attorney, Agent, or Firm*—Cesari and McKenna

[57] ABSTRACT

A framing system includes four corner engaging brackets held on a rigid picture assembly by a flexible binding cord. Each bracket is formed by bending a piece of rigid metal wire to form a loop at the rear face of the assembly and a pair of hooked arms that straddle adjacent edges of the assembly at each corner. The binding cord is applied to the brackets so that it pulls each bracket tightly onto the assembly whether or not the assembly is hung by the cord. The cord also assumes the form of an inverted "V", the apex of which provides a rigid, automatically centered point for hanging the assembly.

9 Claims, 5 Drawing Figures

FRAMING SYSTEM

BACKGROUND OF THE INVENTION

This invention relates generally to systems for exhibiting pictures, photographs, paintings and like items and, more particularly, to a framing system for such items including corner-engaging brackets held together by a flexible binding cord.

Various forms of picture frames are available on the market. A typical frame includes four sections of rigid framing material, the edges of which are beveled at an angle of 45 degrees relative to the length of the sections. The sections are disposed around the periphery of a picture with the beveled edges of the sections abutted to form a miter joint at each corner. The sections are then suitably secured together, typically at the corners.

As is known, frames of this type are typically difficult and expensive to fabricate. To have a neat, professional appearance, each frame section must be precisely cut to a length determined by the particular dimensions of the picture. The beveled edges of each section must also be precisely formed in order for the sections to abut completely at each corner. Typically, once the frame is formed, it cannot be readily used with other pictures unless they have dimensions substantially identical to those of the picture for which the frame was formed.

Additionally, with frames of the above type, a significant portion of the frame is exposed at the front face of the picture. The exposed portions of the frame are often finished so as to have a decorative appearance. This finishing further adds to the cost of the frame. Moreover, because the frame is exposed, care must typically be taken to match the appearance of the frame to the particular decor of the room in which the picture is to be exhibited. It is thus not always possible to move the pictures freely from room to room. Furthermore, exposed frames in many cases detract from the esthetic qualities of the picture itself. This is particularly true with photographs or when the pictures are to be associated with other items having modern or contemporary decorative styles.

A wide variety of simplified framing systems have heretofore been proposed in an effort to eliminate the noted drawbacks of conventional frames. A typical simplified framing system includes two or more support members or brackets which engage the edges or corners of a picture. The brackets are often adjustable so that the framing system can be used with any of a range of picture sizes. In one common construction, brackets are held on a rigid picture assembly by a flexible binding cord that is secured to the brackets at the rear of the assembly. To provide the desired rigidity, the picture is typically sandwiched between a front cover of glass or transparent plastic and a rigid backing. Since the brackets and cords are easily mounted to the picture assembly, it is relatively easy to change the pictures whenever desired.

Unfortunately, prior framing systems utilizing brackets and binding cords are not especially known for their strength and stability. In some cases, the binding cord is attached to the brackets in such a manner that the brackets tightly engage the picture assembly only when it is hung by the binding cord. Thus, for example, when the assembly is held in one's hands, the brackets loosen and the components of the picture assembly can become misaligned. In other cases, the binding cord normally holds the brackets tightly on the picture assembly.

However, when the assembly is hung by the cord, the weight of the assembly causes the cord to stretch and some or all of the brackets to loosen on the assembly. Thus, for example, when the assembly is being adjusted while on a wall, the components of the assembly can also be slipped out of alignment.

It is, therefore, a general object of this invention to provide an improved system for exhibiting pictures, photographs, paintings and like items.

Another object of the invention is to provide an improved framing system of the type including brackets for engaging the corners of a picture assembly which are held together by a flexible binding cord.

Another object of the invention is to provide a framing system of the type described in which the brackets tightly engage the picture assembly whether or not the assembly is hung by the binding cord.

Another object of the invention is to provide a framing system of the type described in which the binding cord provides a rigid, automatically centered point for hanging the picture assembly.

Still another object of the invention is to provide a framing system of the type described which is both simple in construction and inexpensive to fabricate.

SUMMARY OF THE INVENTION

Briefly, a framing system fabricated in accordance with this invention includes a plurality of corner engaging brackets and a length of flexible binding cord. Each bracket includes a loop defining an opening and a pair of arms which extend from the loop. The end portion of each arm is in the form of a hook. Each bracket is disposed at a corner of a rigid picture assembly so that the hooks straddle adjacent edges of the assembly and the loops are adjacent the rear face of the assembly. The binding cord interconnects and holds the brackets on the assembly.

In accordance with a specific aspect of the invention, the binding cord is attached to the brackets in a unique manner which prevents loosening of the brackets and insures continued stability of the framing system. In the illustrative embodiment, for example, one end of the cord is secured to the loop of the lower left hand bracket, as viewed from the rear of the assembly. The free end of the cord is then successively passed through the openings in the loops of each of the other brackets and also through the opening in the loop of the lower left hand bracket. The cord is then passed over the section of cord between the two upper brackets, again passed through the loop of the lower right hand bracket, pulled taut and secured to the loop of the lower left hand bracket.

The cord, when applied in this manner, pulls all four brackets uniformly and tightly toward the center of the picture assembly. Additionally, the cord forms an inverted "V" at the rear of the picture assembly. The apex of the "V" provides a rigid, automatically centered point for hanging the assembly from a single hook, nail or similar fastener in a wall. When the assembly is hung at this point of the binding cord, the weight of the assembly, instead of loosening the brackets, pulls each of the brackets more tightly toward the center of the assembly. The result is a relatively strong and stable framing system.

The invention is pointed out with particularity in the appended claims. The foregoing and other features and advantages of the invention will be better understood from the following detailed description taken in conjunction with the accompanying drawing.

DETAILED DESCRIPTION OF ILLUSTRATIVE EMBODIMENT

Figure 1:
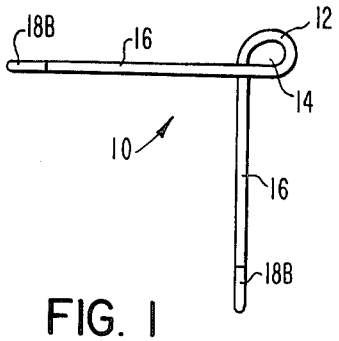
FIGS. 1, 2 and 3 are top, side and perspective views, respectively, of a corner bracket utilized in a framing system embodying the invention.
Figure 3:
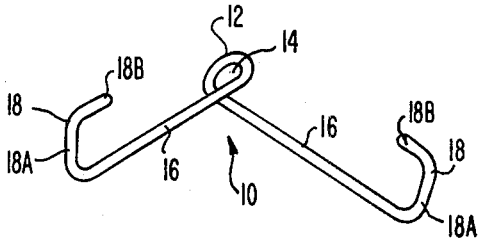
Figure 2:
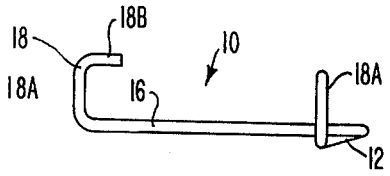

A corner bracket 10 of the type utilized in the framing system fabricated in accordance with this invention is illustrated in FIGS. 1, 2 and 3. As is apparent from the FIGURES, the bracket 10 has a relatively simple construction. It includes a loop 12 defining an opening 14 and a pair of arms 16 extending away from the loop 12. The arms 16 are disposed at a right angle to one another. As best seen in FIGS. 2 and 3, the end portion of each arm 16 is in the form of a hook 18. Each hook 18 includes a portion 18A that extends at a right angle to the arm 16 and a second portion 18B that extends parallel to the arm 16 back toward the loop 12.

The bracket 10 is preferably formed from a single length of rigid metal wire. The loop 12 may, for example, be formed by bending a central portion of the wire around a mandrel. Each hook 18 may then be formed by two successive right angle bends of the end portions of the wire.

Figure 4:
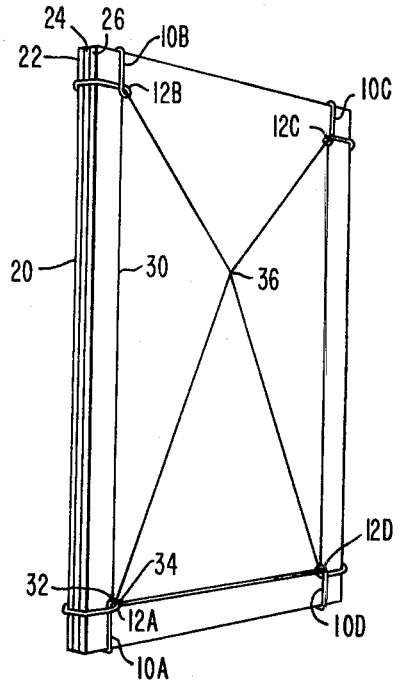
FIG. 4 is a rear, perspective view of a picture assembly which has been framed using the framing system embodying the invention.

FIG. 4 illustrates the framing system of the invention mounted on a picture assembly 20. The picture assembly 20 illustratively includes a rigid, transparent front cover 22, a picture 24 or like item to be exhibited and a backing 26. The picture 24 is sandwiched between the front cover 22 and the backing 26. The front cover 22 is typically a glass or transparent plastic. The backing 26 may be a stiff piece of cardboard. A window matte (not shown) or similar border may also be disposed between the front cover 22 and the picture 24.

As indicated in FIG. 4, one of the brackets 10 is disposed at each corner of the assembly 20. The brackets are labeled 10A, 10B, 10C and 10D and the loops therein are labeled 12A, 12B, 12C and 12D, respectively, in FIG. 4. Each bracket 10 is arranged so that the hooks 18 thereon straddle adjacent edges of the assembly 20 at each corner. Each of the loops 12 is thus adjacent the rear face of the assembly 20 and points inwardly toward the center portion of the backing 26.

A flexible cord 30 interconnects the brackets 10 and holds the brackets on the picture assembly 20. The cord 30 is attached to the brackets 10 in a unique manner which insures continued stability of the framed assembly 20 and prevents loosening of the brackets 10 relative to the assembly whether or not the assembly is hung by the binding cord 30.

Specifically, in the illustrated embodiment, one end 32 of the binding cord 30 is first secured to the loop 12A of the lower left hand bracket 10A. The free end of the cord is then passed successively, in a clockwise direction, through the loops 12B, 12C and 12D of the brackets 10B, 10C and 10D, respectively, and also through the loop 12A of the bracket 10A. The cord is then looped over the section of cord between the brackets 10B and 10C and again passed through the loop 12D of the bracket 10D. Finally, the cord 30 is pulled taut and secured at 34 to the loop 12A of the bracket 10A.

When applied in this manner, the cord 30 pulls each bracket 10 uniformly toward the center portion of the picture assembly 20. The pulling force is determined essentially by the amount of tension that is placed on the cord 30 before it is secured at 34. The brackets 10 thus tightly engage the assembly 20 and prevent the front cover 22, picture 24 and backing 26 from slipping out of alignment when the assembly 20 is handled.

The cord 30 also assumes the form of a rigid, inverted "V" at the rear face of the assembly 20. The apex 36 of the "V" conveniently provides a rigid, automatically centered point for hanging the assembly 20. The assembly 20 can thus be hung on a wall using a single hook, nail or similar fastener which engages the point 36 of the cord 30. When the assembly 20 is hung in this manner, the weight of the assembly 20 does not tend to loosen the brackets 10 but instead forces the brackets 10 to hold the assembly more tightly. Misalignment of the cover 22, picture 24 and backing 26 is thus also prevented when the assembly 20 is hung on a wall.

Figure 5:
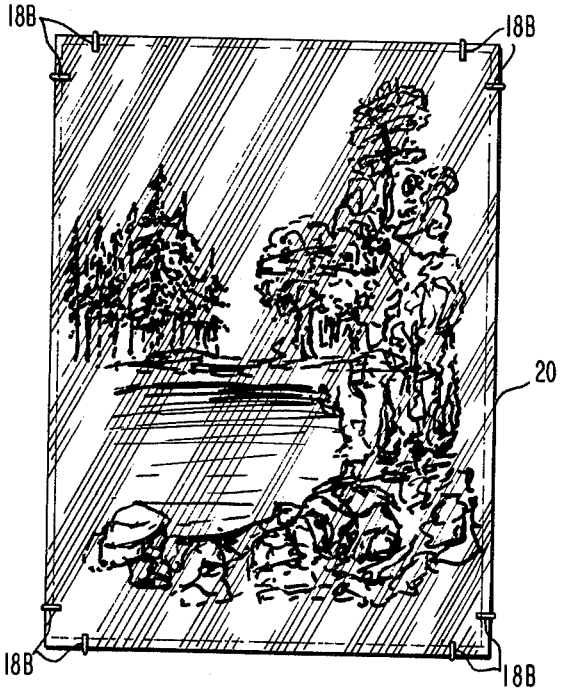
FIG. 5 is a front view of the picture assembly of FIG. 4.

FIG. 5 illustrates the front face of the framed assembly 20 of FIG. 4. It can be seen that only the relatively short end portion 18B of each hook 18 is visible at the front face of the assembly 20. There is thus no substantial portion of the framing system visible to distract a viewer's attention from the picture 24. Additionally, the framed assembly 20 has a generally modernistic appearance so as to be particularly compatible with contemporary decorative styles.

The metal wire used for the brackets 10 is preferably sufficiently strong and hard to withstand the stress that is placed thereon as a result of the tension of the binding cord 30. The metal wire is also preferably rust and tarnish resistant. For these reasons, surface-treated steel wire has been found to be useful for the brackets 10.

The cord 30 is flexible and preferably has sufficient elasticity and/or yield strength so that the cord 30 does not stretch significantly after it is attached to the brackets 10. The cord 30 is also preferably smooth surfaced so that it slides freely relative to itself and to the loops 12 of the brackets 10. Conventional nylon fishing line has been found to be particularly useful for the cord 20.

A specific illustrative embodiment of the invention includes four brackets 10. Each bracket is formed from 12 gauge galvanized steel wire. Each arm 16 of the bracket has a length of about 1.5 inches. The portion 18A of each hook 18 has a length of about $\frac{3}{8}$ of an inch. The binding cord 30 is cut from conventional 40 pound test nylon fishing line.

As will be apparent, the above described framing system is illustrative only of one specific embodiment of the invention and can be modified in many ways by those skilled in the art. For example, although metal wire is preferred for the brackets 10, they can also be formed from other materials such as plastic, glass or wood. Instead of using a single piece of wire for each bracket 10, the brackets may be formed by welding two or more pieces of wire together. The loop 12 in each bracket 10 could also be replaced by a simple hook which defines an opening for receiving the binding cord 30. The binding cord 30 may be formed from various natural or synthetic materials other than nylon.

Variations may also be made in the manner of attaching the cord 30 to the brackets 10 without sacrificing the advantages noted above. For example, the first end 32 of the cord 30 may be initially secured to the loop 12 of any one of the brackets 10. The free end of the cord 30 may then be fed through the other loops 12 in a counterclockwise rather than a clockwise direction. Also, in the specific embodiment described above, the second end 34 of the cord 30 may be secured to the loop 12D of the bracket 10D instead of to the loop 12A of the bracket 10A.

Furthermore, any suitable technique may be utilized in securing the ends 32 and 34 of the cord 30. The ends of the cord 30 may, for example, be tied to a loop 12. Alternatively, the end 32 may be passed through the loop 12, doubled back and secured to the cord 30 itself. This could be accomplished, for example, using an open metal sleeve which is placed around the double backed sections of the cord 30 and then crimped to secure them together. The end 34 of the cord 30 could be similarly secured to a loop 12 or to the section of the cord 30 extending between the brackets 10A and 10D in FIG. 4.

Hence, I believe that these and other modifications are clearly within the true spirit and scope of the invention, and it is the object of the appended claims to cover all such modifications.

What I claim as new and desire to secure by Letters Patent of the United States is:

1. A framing system for a rigid assembly including a picture or like item to be exhibited, front and rear major faces and a plurality of corners, said system comprising:

A. bracket means for each corner of the assembly, each of said bracket means including:
   i. means disposed adjacent the rear face of the assembly and defining an opening,
   ii. first and second arms extending away from said opening defining means toward adjacent edges of the assembly at the corner, and
   iii. hook means at the end of each of said first and second arms for engaging the adjacent edges of the assembly; and B. a one-piece, flexible binder cord for interconnecting said bracket means at the rear face of the assembly, for providing a point for hanging the assembly and for holding said bracket means on the assembly whether or not the assembly is hung by said cord, said cord including:
   i. a first end which is secured to said opening defining means in one of said bracket means,
   ii. a first intermediate section adjacent said first end which is passed successively through said opening defining means in at least the remaining of said bracket means,
   iii. a second intermediate section adjacent said first intermediate section which is looped around a portion of said first intermediate section extending between two of said remaining bracket means to form an inverted "V" shape, and
   iv. a second end adjacent said second intermediate section which is secured so as to maintain said cord under tension thereby to hold each of said bracket means on the assembly, the apex of the inverted "V" of said second intermediate section providing a rigid, stable, laterally centered point for hanging the assembly.

2. A framing system as recited in claim 1 in which each of said bracket means comprises a length of rigid wire which is bent to form said opening defining means, said first and second arms and said hook means at the end of each of said arms.

3. A framing system as recited in claim 1 in which said second end of said cord is secured to one of said bracket means.

4. A framing system as recited in claim 1 in which said second end of said cord is secured to a portion of said first intermediate section of said cord.

5. A framing system as recited in claim 1 in which the assembly further includes a rigid, transparent front cover and a backing, the picture or like item to be exhibited being sandwiched between the cover and the backing.

6. A framing system as recited in claim 2 in which the rigid wire of each of said bracket means is surface-treated steel wire.

7. A framing system as recited in claim 1 in which said cord is formed from nylon.

8. A framing system for a rigid assembly of the type including a transparent front cover, a picture or like item to be exhibited and a backing, the assembly having two upper and two lower corners, said system comprising:

A. A bracket for each corner of the assembly, each bracket comprising a length of rigid wire which is bent to form
   i. a loop disposed adjacent the backing of the assembly and defining an opening,
   ii. first and second arms extending at a right angle to one another from said loop toward adjacent edges of the assembly at each corner, and
   iii. a hook at the end of each of said first and second arms for straddling the adjacent edges of the assembly; and B. a one-piece, flexible binder cord for interconnecting said brackets adjacent the backing, for providing a point for hanging the assembly and for holding said brackets on the assembly whether or not the assembly is hung by said cord, said cord including
   i. a first end which is secured to said loop of a first one of said brackets disposed at one of the lower corners of the assembly, said cord including
   ii. a first intermediate section adjacent said first end which is passed successively through said loops in at least the remaining of said brackets around the periphery of the assembly,
   iii. a second intermediate adjacent said first intermediate section which is looped around a portion of said first intermediate section extending between two of said remaining brackets disposed at the upper corners of the assembly so as to assume an inverted "V" shape, and
   iv. a second end adjacent said second intermediate section which is secured so as to maintain said cord under tension thereby to hold each of said brackets on the assembly, the apex of the inverted "V" of said second intermediate section providing a rigid, stable, laterally centered point for hanging the assembly.

9. A framing system as recited in claim 8 in which said first intermediate section of said cord is passed successively through said loops in each of said brackets including said first bracket so as to extend completely around the periphery of the assembly.

* * * * *